US011473408B2

(12) United States Patent
Newton et al.

(10) Patent No.: US 11,473,408 B2
(45) Date of Patent: Oct. 18, 2022

(54) EXPANDABLE LINER HANGER WITH POST-SETTING FLUID FLOW PATH

(71) Applicant: Halliburton Energy Services, Inc., Houston, TX (US)

(72) Inventors: Daniel Craig Newton, Dubai (AE); Robert Ross Murdoch, Dubai (AE)

(73) Assignee: Halliburton Energy Services, Inc., Houston, TX (US)

( * ) Notice: Subject to any disclaimer, the term of this patent is extended or adjusted under 35 U.S.C. 154(b) by 142 days.

(21) Appl. No.: 16/914,918

(22) Filed: Jun. 29, 2020

(65) Prior Publication Data

US 2021/0404298 A1 Dec. 30, 2021

(51) Int. Cl.

| | |
|---|---|
| ***E21B 43/10*** | (2006.01) |
| ***E21B 23/01*** | (2006.01) |
| ***E21B 33/12*** | (2006.01) |
| ***E21B 33/14*** | (2006.01) |
| ***E21B 34/10*** | (2006.01) |

(52) U.S. Cl.

CPC ..... *E21B 43/10* (2013.01); *E21B 23/01* (2013.01); *E21B 33/12* (2013.01); *E21B 33/14* (2013.01); *E21B 34/10* (2013.01); *E21B 2200/06* (2020.05)

(58) Field of Classification Search

CPC ..... E21B 43/10; E21B 23/01; E21B 33/12; E21B 33/14; E21B 34/10; E21B 2200/06; E21B 21/103

See application file for complete search history.

(56) References Cited

U.S. PATENT DOCUMENTS

| | | | | |
|---|---|---|---|---|
| 6,648,075 | B2 | 11/2003 | Badrak et al. | |
| 6,739,398 | B1 | 5/2004 | Yokley et al. | |
| 7,278,492 | B2 | 10/2007 | Braddick | |
| 7,337,840 | B2 * | 3/2008 | Penno | E21B 43/045 166/278 |
| 7,380,604 | B2 | 6/2008 | Adam et al. | |
| 7,441,606 | B2 | 10/2008 | Maguire | |
| 9,650,868 | B2 | 5/2017 | Themig et al. | |
| 9,856,714 | B2 | 1/2018 | Giroux | |
| 10,053,954 | B2 | 8/2018 | Stautzenberger et al. | |

(Continued)

FOREIGN PATENT DOCUMENTS

| | | |
|---|---|---|
| EP | 3241984 | 11/2017 |
| GB | 2531175 | 2/2018 |
| WO | 2015038171 | 3/2015 |

OTHER PUBLICATIONS

PCT Application No. PCT/US2020/040086 , International Search Report and Written Opinion, dated Mar. 16, 2021, 13 pages.

(Continued)

*Primary Examiner* — Michael R Wills, III

(74) *Attorney, Agent, or Firm* — Kilpatrick Townsend & Stockton LLP

(57) ABSTRACT

A wellbore completion system includes an expandable liner hanger with a post-setting fluid flow path. The system includes an expandable liner hanger that can be expanded by a running tool prior to a completion operation in a wellbore. The system also includes a circulating sleeve that can be manipulated by the running tool. The circulating sleeve can provide a return path for fluid internal to the expandable liner hanger for the completion operation that is performed subsequent to releasing the running tool from the expandable liner hanger.

20 Claims, 6 Drawing Sheets

(56) References Cited

U.S. PATENT DOCUMENTS

| | | | | |
|---|---|---|---|---|
| 2008/0110620 | A1 | 5/2008 | Penno | |
| 2014/0251609 | A1 | 9/2014 | Broussard et al. | |
| 2017/0342800 | A1* | 11/2017 | Themig | E21B 33/146 |
| 2019/0153810 | A1 | 5/2019 | Cervo et al. | |
| 2019/0153825 | A1 | 5/2019 | Bourgneuf et al. | |

OTHER PUBLICATIONS

Baker Hughes, "Cementing Valves and Inflation Tools", 2 pages, 2020.
Baker Hughes , "TORXS Expandable Liner Hanger", 1 page, 2011.
Halliburton , "Fidelis Stage Cementer", 2 pages, 2015.
Halliburton, "VersaFlex Expandable Liner Hanger System", 2 pages, 2013.
Schlumberger, "Heat Hybrid Expandable Liner Hanger", 2 pages, 2013.
Tiw, "XPack Expandable Liner Hanger System", 7 pages, 2018.
Weatherford, "Eliminator GT Stage Tool", 8 pages, 2016.
Weatherford, "TruForm Expandable Liner Hanger System", 1 page, 2012.

* cited by examiner

EXPANDABLE LINER HANGER WITH POST-SETTING FLUID FLOW PATH

TECHNICAL FIELD

The present disclosure relates generally to wellbore completion operations and, more particularly (although not necessarily exclusively), to maintaining fluid circulation after setting an expandable liner hanger.

BACKGROUND

The hydrocarbon extraction industry makes use of wellbore drilling to explore and recover natural resources such as water, oil, and gas. After a wellbore is drilled, completion operations are performed on the wellbore to allow hydrocarbons to flow out of the formation and up to the surface. Completion operations can include, among other things, casing, cementing, and perforating the wellbore.

An expandable liner hanger is a tool that can allow a liner or a casing, to be suspended from the internal wall of a previously assembled length of pipe in a wellbore. Expanding the liner hanger can seal the liner hanger to the pipe, which can remove a path for fluid circulation in the wellbore. Completion operations can involve a circulation path after cementing, which is difficult to maintain after setting the expandable liner hanger.

DETAILED DESCRIPTION

Figure 1:
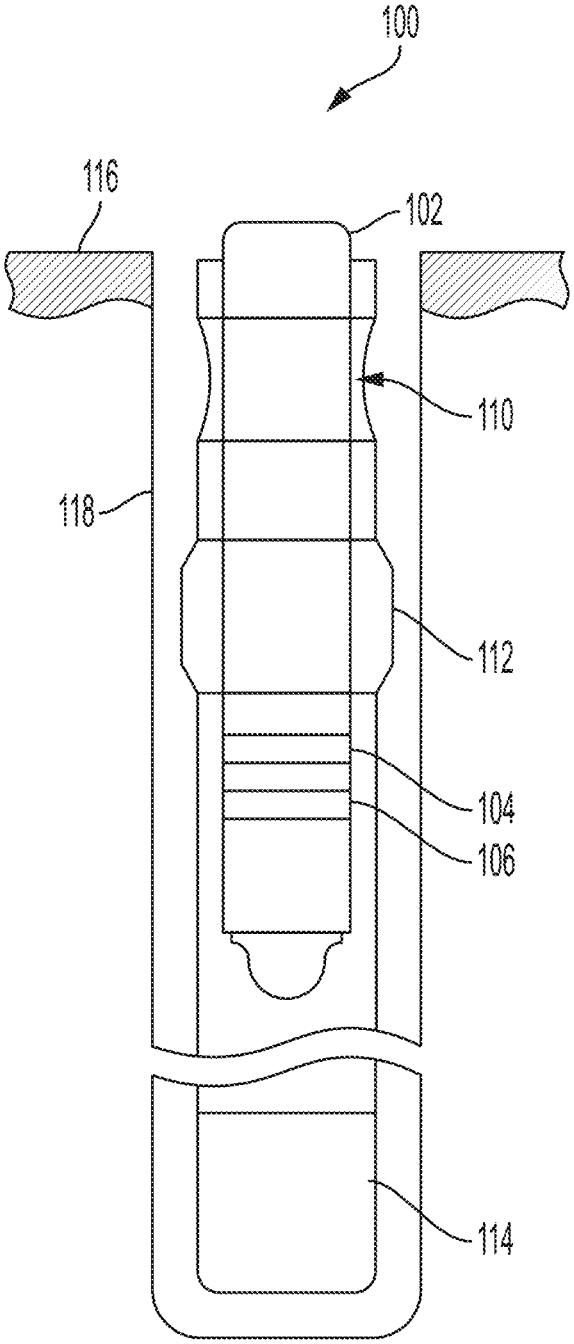
FIG. 1 is a schematic of a system for completing a wellbore and setting an expandable liner hanger according to one example of the present disclosure.

Certain aspects and examples of the present disclosure relate to maintaining fluid circulation after setting an expandable liner hanger in a wellbore completion operation. Fluid circulation includes water, mud, cement slurry, or other fluids flowing in a wellbore. The path for fluid circulation can be lost after an expandable liner hanger is set and released from the running tool. In some examples, a circulating sleeve can be used in conjunction with an expandable liner hanger to provide a return path internal to the expandable liner hanger for fluid for the completion operation that is performed after releasing the running tool from the expandable liner hanger.

In some completion operations, such as those involving hydraulically actuated screens and off-bottom cementing applications, the expandable liner hanger may be set to isolate tools below the expandable liner hanger from running tool manipulations, prior to performing further operations. Some completion operations may not sustain setting the expandable liner hanger prior to actuating the downhole components because the completion operations involve a circulation path post cementing. Setting the expandable liner hanger prior to performing the completion operation can also cause a potential surge of formation fluid during the liner hanger expansion process.

Some features, such as contingency setting and contingency release mechanisms, may rely on manipulating the workstring against the set liner hanger. These features may also rely on manipulating the workstring against a weight generated by a liner shoe against the end of the borehole. Some applications of lower completions, such as hydraulically activated and expandable screens, involve components to be set against the open hole. This can preclude the use of contingency expandable hanger features against these components due to the risk of mechanical damage as loads are passed through them. Setting the liner hanger prior to actuating the downhole components may maintain the use of these contingency features. But, completion operations involving a circulation path post hanger setting may not sustain setting the liner hanger before actuating the downhole components.

In some completion operations, a running tool can remain coupled to a liner hanger during a completion operation, such as a cementing operation. Operational risks are associated with setting and releasing the liner hanger after beginning the completion operation. For example, if cement from a cementing operation is in the wellbore before the liner hanger is expanded and running tool released, any operational issues with operation of the running tool may lead to cement setting around the running tools. In some examples, an assembly is provided that allows for deploying an expandable liner hanger and maintaining the ability to circulate fluid after setting the expandable liner hanger including the capability to release the running tool prior to cementing. The assembly can include expandable liner hanger equipment, a circulating sleeve, a mechanically shut circulation valve, an optional hydraulic lock mechanism, and other downhole components, such as completion assemblies, that can be run with a running tool in conjunction with a packoff system and a set-down weight tool. The running tool can expand the expandable liner hanger prior to a completion operation in a wellbore. The circulating sleeve can include a controllable circulation valve. The running tool can manipulate the circulating sleeve of the assembly to provide a return path internal to the expandable liner hanger for fluid for the completion operation that occurs after releasing the running tool from the expandable liner hanger.

In some examples, the circulating sleeve can refer to a portion of the assembly positioned between the expandable liner hanger and components of the completion assembly.

An example of a completion operation can include an off-bottom cementing operation. The completion assembly for that example can include a cementing plug, a cementing valve, a shut-off collar, a packer, and a ported bull nose. The circulating sleeve can be positioned between the expandable liner hanger and the cementing plug, which may be uphole to other components of the completion assembly. The circulating sleeve can include a circulating housing with a controllable circulation valve, or port, for providing fluid communication between the return path and an annulus of the wellbore. The circulating sleeve can also include a profile that extends from the circulating housing. The profile can be coupled to a set-down weight feature during the completion operation. After the completion operation, a mating component on the running tool can be coupled to an internal sleeve to close the port and prevent fluid communication between the inner area and the annulus. The mating component can be incorporated into or separate from the set-down weight feature. The mating component can shift the internal sleeve to a closed position by mechanical means, such as upward movement. In some examples, the circulating sleeve may be shifted closed or locked closed by rotation of the running tool. A shoulder of the circulating sleeve can receive the mating component within the running tool after the port is closed.

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 is a schematic of a system 100 for completing a wellbore 118 and setting an expandable liner hanger 110 according to one example of the present disclosure. During a well completion operation, a running tool 102 can be run downhole, below a surface 116 of the earth. The completion operation may include cementing the wellbore 118 or a fluid displacement operation such as stimulation or breaker displacement. The running tool 102 can include a set-down weight feature 104, a packoff 106, and a cementing plug 108. The packoff 106 can create a seal between the running tool 102 and an inner diameter of the expandable liner hanger 110 to force the fluid to travel downhole and prevent fluid from traveling up an annulus of the wellbore 118 during the completion operation. The packoff 106 can be any suitable sealing device including chevron seals, swab cups, bonded seals, and o-rings.

In some examples, the running tool 102 can run an assembly of an expandable liner hanger 110, a circulating sleeve 112, and a completion assembly 114 downhole. The expandable liner hanger 110 can be used to hang a liner from an internal wall of a casing that has been previously set in the wellbore 118. The circulating sleeve 112 can allow a fluid circulation path to be established internal to the expandable liner hanger 110 during a completion operation performed after the expandable liner hanger 110 is set and released from the running tool 102.

The components of the completion assembly 114 can vary, depending on the type of completion operation to be implemented. For example, the completion assembly 114 for off-bottom cementing applications can include a cementing plug, a cementing valve, a packer, a shut-off collar, and a ported bull nose. The completion assembly 114 for hydraulically actuated screen applications can include a cementing valve, a packer, a shut-off collar, and a ported bull nose. For cemented liner applications, the completion assembly 114 can include a cementing plug, a landing collar, and a ported bull nose. For completion operations involving cementing, the completion assembly can be referred to as a cementing assembly.

Figure 2:
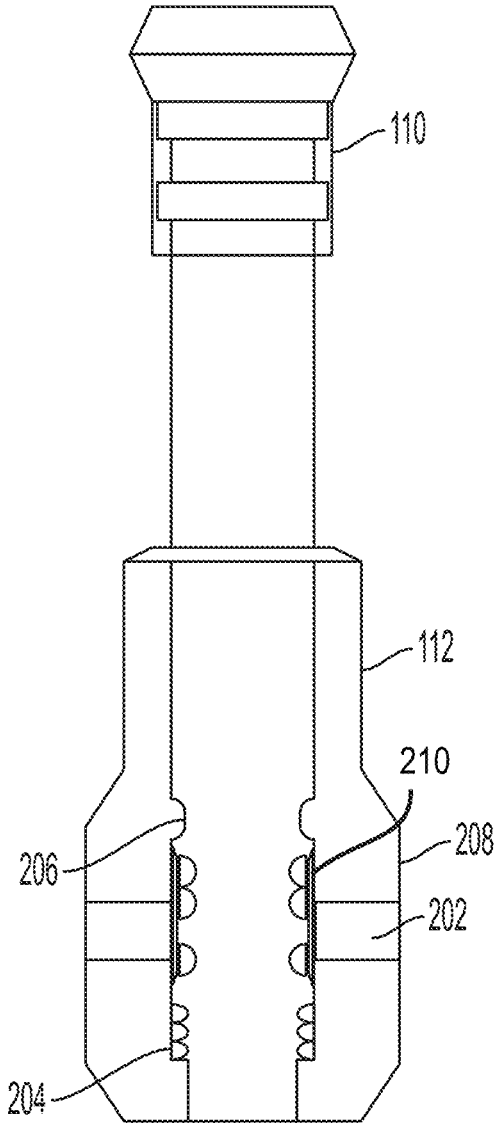
FIG. 2 is a partial cross-sectional view of a circulating sleeve and an expandable liner hanger as part of a liner hanger assembly according to one example of the present disclosure.

FIG. 2 is a partial cross-section view of a circulating sleeve 112 and an expandable liner hanger 110 as part of a liner hanger assembly according to one example of the present disclosure. The circulating sleeve 112 can include a circulating housing 208, a port 202, a profile 204, a shoulder 206, and an internal sleeve 210.

After the expandable liner hanger 110 is set and a running tool is released, the running tool can be raised to couple a set-down weight feature on the running tool to the profile 204 extending from the circulating housing 208 of the circulating sleeve 112. Coupling the set-down weight feature to the profile 204 can allow the application of a set-down weight during subsequent completion operations. The running tool can be raised to couple the running tool with the internal sleeve 210. The running tool can manipulate the internal sleeve 210 into an open position and create a return path for fluid through the circulating sleeve 112 that is internal to the expandable liner hanger 110. The port 202 can provide fluid communication between the return path and an annulus of the wellbore during the completion operation. After the completion operation, the running tool can be raised to manipulate the internal sleeve 210 to a closed position to prevent fluid communication through the port 202 between the inner area and the annulus. The running tool can couple the set-down weight feature of the running tool to the shoulder 206 of the circulating sleeve 112 after the port 202 is closed.

The circulating sleeve 112 can allow the expandable liner hanger 110 to be expanded and the running tool to be released prior to the completion operation being performed. The circulating sleeve 112 can allow a flow path to be established internal to the expandable liner hanger 110 during the completion operation to allow fluid to continue circulating in the wellbore. The potential for operational risks can decrease when the running tool is released before the completion operation is performed.

Figure 3A:
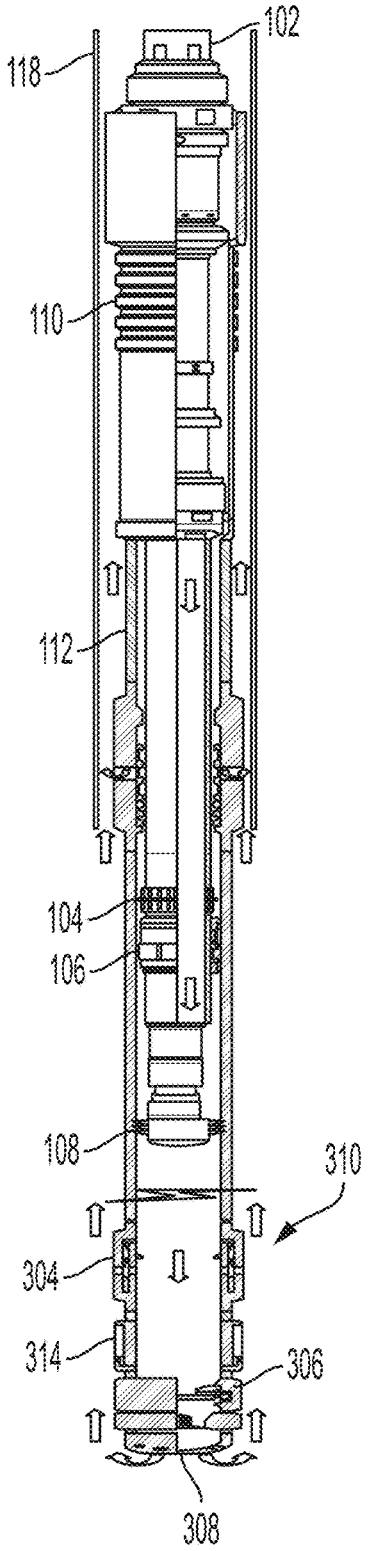
FIG. 3A is a schematic of an assembly of an expandable liner hanger with a post-setting fluid flow path in a run-in-hole configuration according to one example of the present disclosure.

FIGS. 3A-3F are schematics of a wellbore in which an expandable liner hanger 110 can be used with a completion assembly 310 according to one example of the present disclosure. Together, the schematics of FIGS. 3A-3F illustrate a process for completing a wellbore 118 and setting the expandable liner hanger 110 according to one example of the present disclosure. In particular, FIG. 3A depicts an assembly of an expandable liner hanger 110 with a post-setting fluid flow path. The assembly includes an expandable liner hanger 110, a circulating sleeve 112, and the completion assembly 310. A running tool 102 is depicted in a run-in-hole configuration for running the assembly to the total depth of a wellbore 118. The running tool 102 can include a packoff 106 and a set-down weight feature 104. The packoff 106 can be any suitable sealing device to seal between the running tool 102 and an inner diameter of a liner housing for the expandable liner hanger 110.

In some examples, such as off-bottom cementing applications, the completion assembly 310 can include a cementing plug 108, a cementing valve 304, a packer 314, a shut-off collar 306, and a ported bull nose 308. The cementing plug 108 and cementing valve 304 can be manipulated during the completion operation to control fluid circulation in the wellbore 118. The packer 314 can isolate a zone in the wellbore 118 for the cementing operation. Other applications, such as hydraulically actuated screen applications and cemented liner applications, can include completion assemblies with different components.

Fluids such as drilling fluid, brine, or water can circulate down through the running tool 102, out the ported bull nose 308 of the completion assembly 310, and back up through the wellbore 118 to the surface. The fluid can travel along a return path in the wellbore 118 external to the expandable liner hanger 110.

Figure 3B:
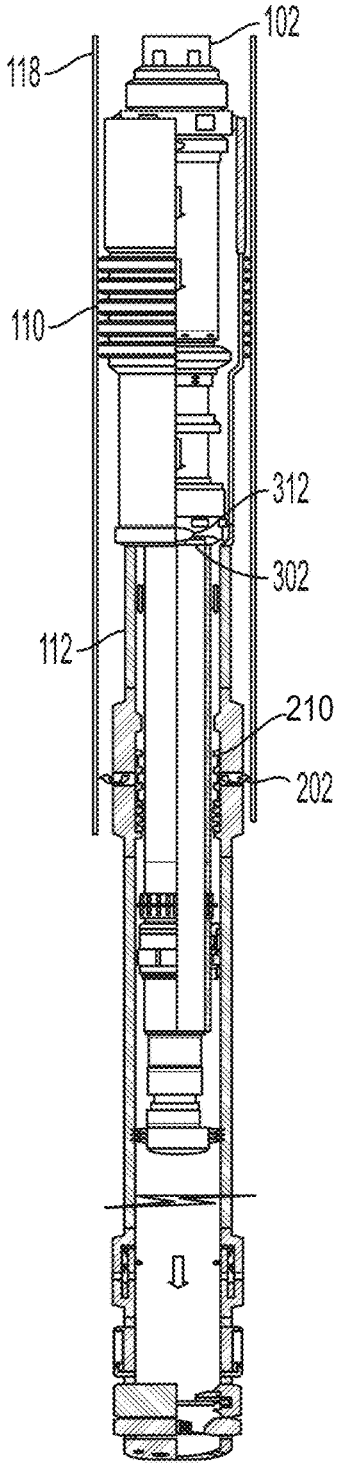
FIG. 3B is a schematic of a running tool expanding the expandable liner hanger of FIG. 3A to create a seal in the wellbore according to one example of the present disclosure.

FIG. 3B depicts the running tool 102 expanding the expandable liner hanger 110 to create a seal in the wellbore 118 according to one example of the present disclosure. The running tool 102 can release a device 312 that can land in a landing element 302 of the running tool 102. The device 312 can be a ball or other component that can block off fluid communication above and below the landing element 302. In some examples, the landing element 302 can be a mechanically activated seat to receive the device 312 downhole to the expandable liner hanger 110. Pressure can build up in the running tool 102, causing the expandable liner hanger 110 to expand.

Fluid can flow downhole external to the running tool 102 and internal to the expandable liner hanger 110. A port 202 in the circulating sleeve 112 can allow fluid to exit below the landing element 302. The circulating sleeve 112 can include one port 202 or multiple ports. In some examples, an internal sleeve 210 can be in an open position to allow access to the port 202 before the running tool 102 runs the expandable liner hanger 110 downhole. In an alternative example, the port 202 can be initially closed and the running tool 102 can manipulate the internal sleeve 210 to an open position and allow access to the port 202 after the expandable liner hanger 110 is expanded. Additionally or alternatively, a shifting tool that is located uphole to the circulating sleeve 112 on the running tool 102 can manipulate the internal sleeve 210 and open the port 202 when the running tool 102 is moved downhole.

Figure 3C:
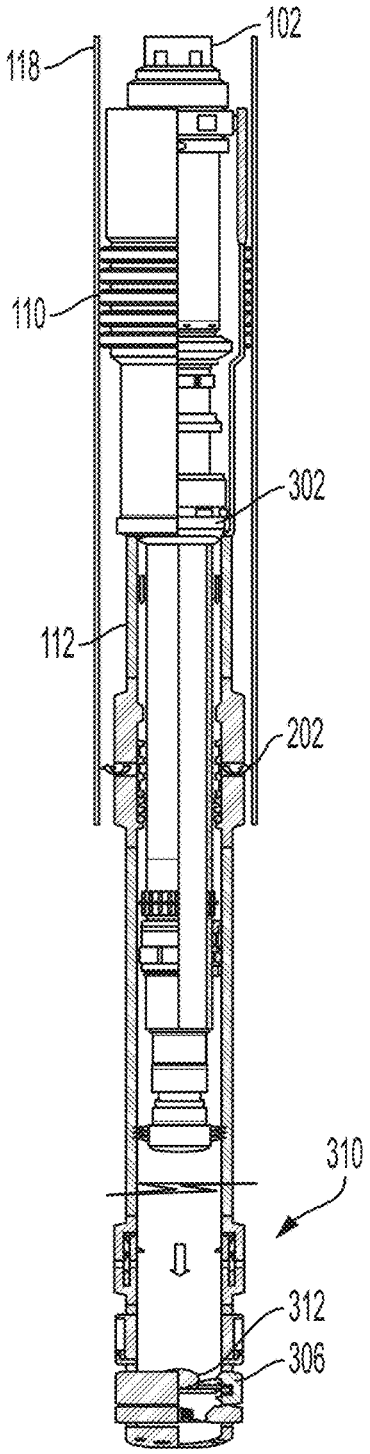
FIG. 3C is a schematic of the running tool of FIG. 3B being released from the expandable liner hanger according to one example of the present disclosure.

FIG. 3C shows the running tool 102 being released from the expandable liner hanger 110 and fluid circulation being reestablished in the running tool 102 in the wellbore 118 according to one example of the present disclosure. The running tool 102 can manipulate the landing element 302 to cause the device 312 to fall downhole. When the device 312 falls downhole, communication can be reopened above and below the landing element 302. In some examples, the device 312 can land in the shut-off collar 306 of the completion assembly 310. The shut-off collar 306 can be in an open position before receiving the device 312. The device 312 can apply pressure to the shut-off collar 306 to cause the shut-off collar 306 to close, removing the path for fluid circulation beyond the shut-off collar 306. Fluid can travel downhole through the circulating sleeve 112, internal to the expandable liner hanger 110, and out the port 202 of the circulating sleeve 112.

Figure 3D:
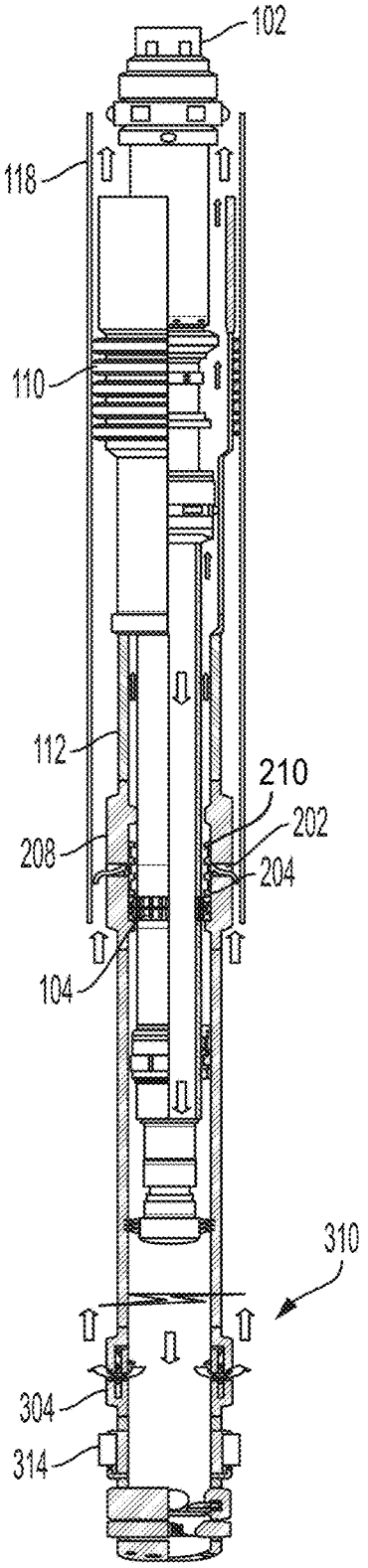
FIG. 3D is a schematic of a running tool being manipulated to create a fluid return path internal to the expandable liner hanger of FIG. 3A according to one example of the present disclosure.

FIG. 3D depicts the running tool 102 being manipulated to create a fluid return path internal to the expandable liner hanger 110 according to one example of the present disclosure. The running tool 102 can be raised, at least partially, to set the set-down weight feature 104 on a profile 204 of the circulating sleeve 112. The profile 204 can extend from a circulating housing 208 to an inner area defined by the assembly. Setting the set-down weight feature 104 on the profile 204 can allow the application of the set-down weight during subsequent completion operations. The running tool 102 can be raised to couple the running tool 102 to the internal sleeve 210. The running tool 102 can manipulate the internal sleeve 210 into an open position and create a return path for fluid through the circulating sleeve 112. The port 202 can provide fluid communication between the return path and an annulus of the wellbore during the completion operation. Raising the running tool 102 can create a pressure change in the wellbore 118. The pressure change can actuate the packer 314 and open the previously shut cementing valve 304 of the completion assembly 310. Opening the cementing valve 304 can create a path for fluid to exit the assembly downhole from the running tool 102.

Figure 3E:
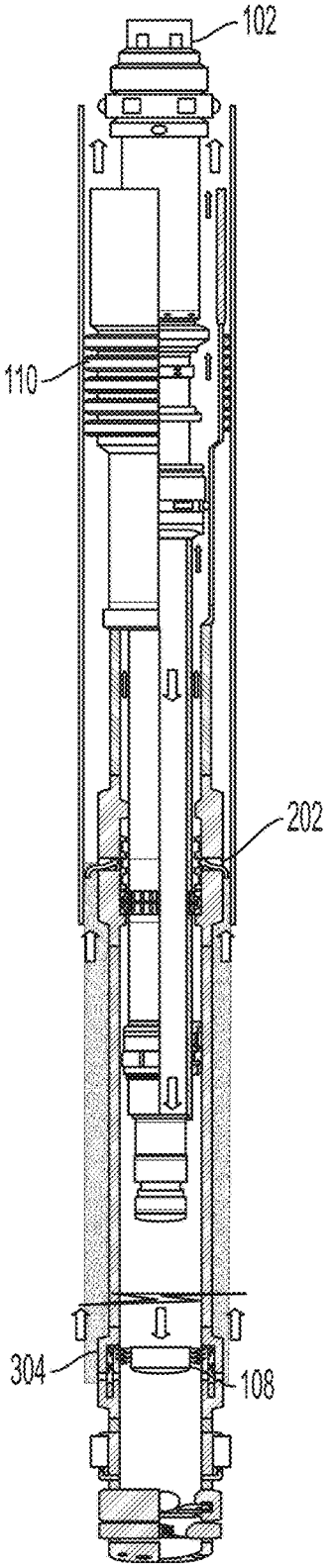
FIG. 3E is a schematic of a completion operation using an internal flow path of the expandable liner hanger of FIG. 3A according to one example of the present disclosure.

FIG. 3E shows the completion operation using an internal flow path of the expandable liner hanger 110 according to one example of the present disclosure. The fluid can be pumped downhole internal to the running tool 102. In some examples, the fluid can be cement. The fluid can travel past the running tool 102 and out the cementing valve 304 of the completion assembly 310. The fluid can travel up the wellbore 118 and through the port 202 that is open in the circulating sleeve 112. The fluid can continue to circulate along a return path external to the expandable liner hanger 110 in an inner area defined by the expandable liner hanger 110.

The cementing valve 304 can be closed after the completion operation. The running tool 102 can release the cementing plug 108, which can land downhole in the cementing valve 304. The cementing plug 108 can apply pressure to the cementing valve 304 to cause the cementing valve 304 to close. Fluid can be prevented from flowing past the running tool 102 and out the cementing valve 304. The fluid that exited through the cementing valve 304 before the cementing valve 304 was closed can continue to circulate through the port 202 and internal to the expandable liner hanger 110.

Figure 3F:
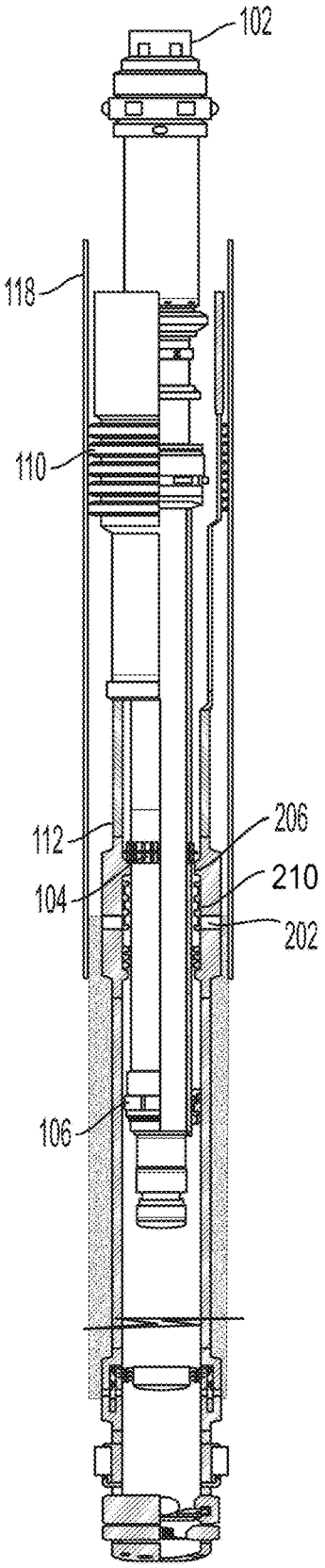
FIG. 3F is a schematic of a port of the expandable liner hanger of FIG. 3A being closed to shut off the circulation path after the completion operation according to one example of the present disclosure.

FIG. 3F depicts closing the port 202 to shut off the circulation path after the completion operation according to one example of the present disclosure. The running tool 102 can be raised to manipulate the internal sleeve 210 to close the port 202 and prevent fluid communication through the port 202 between the inner area and the annulus. The running tool 102 can set the set-down weight feature 104 on a shoulder 206 of the circulating sleeve 112 positioned uphole to the port 202.

Pressure testing can be completed after the port 202 is closed to ensure integrity of the wellbore 118. The pressure test can test the backside of the wellbore 118 against a packoff 106 and the port 202. In some examples, the circulating sleeve 112 can include a hydraulic permanent lock that can be actuated during the pressure test to prevent the port 202 from reopening. After pressure testing, the running tool 102 can be removed from the wellbore 118.

Figure 4:
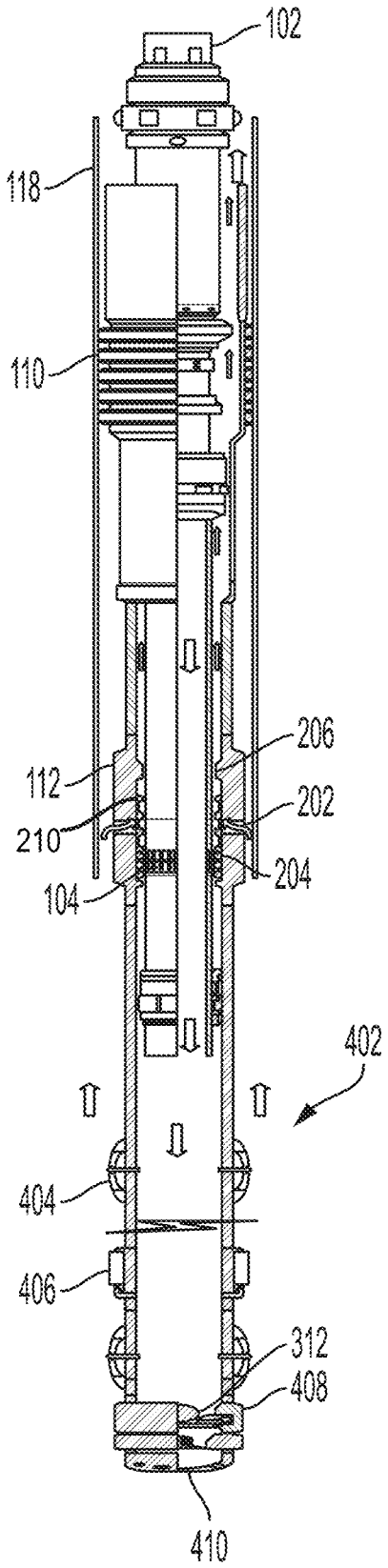
FIG. 4 is a schematic of an expandable liner hanger with a completion assembly for an uncemented liner application according to one example of the present disclosure.

Although FIGS. 3A-3F depict an example of an expandable liner hanger used with completion equipment that includes a cementing assembly, expandable liner hangers according to various examples can be used with other types of completion equipment. For example, FIG. 4 is a schematic of an expandable liner hanger 110 with a completion assembly 402 for an uncemented liner application according to one example of the present disclosure. The uncemented liner application can be a hydraulically actuated screen application. The components of the running tool 102, expandable liner hanger 110, and the circulating sleeve 112 are the same as in FIGS. 3A-3F. The completion assembly 402 for the hydraulically actuated screen application can include a cementing valve 404, a packer 406, and a shut-off collar 408 located between the packer 406 and a ported bull nose 410. The cementing valve 404 in this application can be a hydraulically actuated screen. The completion assembly 402 can include one or multiple cementing valves positioned uphole or downhole of the packer 406.

When a running tool 102 is run in hole to the total depth, fluid can flow through the completion assembly 402, out the ported bull nose 410, and up the wellbore 118 external to the expandable liner hanger 110. For a hydraulically actuated screen application, the running tool 102 can expand and release the expandable liner hanger 110 in the same manner as depicted in FIGS. 3B-3C. The running tool 102 can release a device 312 that can be received by the shut-off collar 408 of the completion assembly. The device 412 can apply pressure to the shut-off collar 408, causing the shut-off collar 408 to close.

The running tool 102 can be raised to couple a set-down weight feature 104 to a profile 204 of a circulating sleeve 112. Prior to the completion operation, the running tool 102 can be raised to couple the running tool 102 with an internal sleeve 210 of the circulating sleeve 112. The running tool 102 can manipulate the internal sleeve 210 to create a fluid return path through a port 202 internal to the expandable liner hanger 110. The pressure change from raising the running tool 102 can actuate the packer 406 and open the cementing valve 404 to allow cement to enter the annulus of the wellbore 118 during the cementing operation. Fluid can be pumped downhole and circulate out of the cementing valve 404. The fluid can flow up the wellbore 118 and through a port 202 of the circulating sleeve 112. In some examples, the circulating sleeve 112 can include a screen over the port 202 to prevent the port 202 from being plugged with sand or other debris. The fluid can continue along a return path internal to the expandable liner hanger 110. After the completion operation, the running tool 102 can be raised to manipulate the internal sleeve 210 to close the port 202 and prevent fluid flow through the port 202. The running tool 102 can be raised to couple the set-down weight feature 104 to a shoulder 206 of the circulating sleeve 112.

Figure 5:
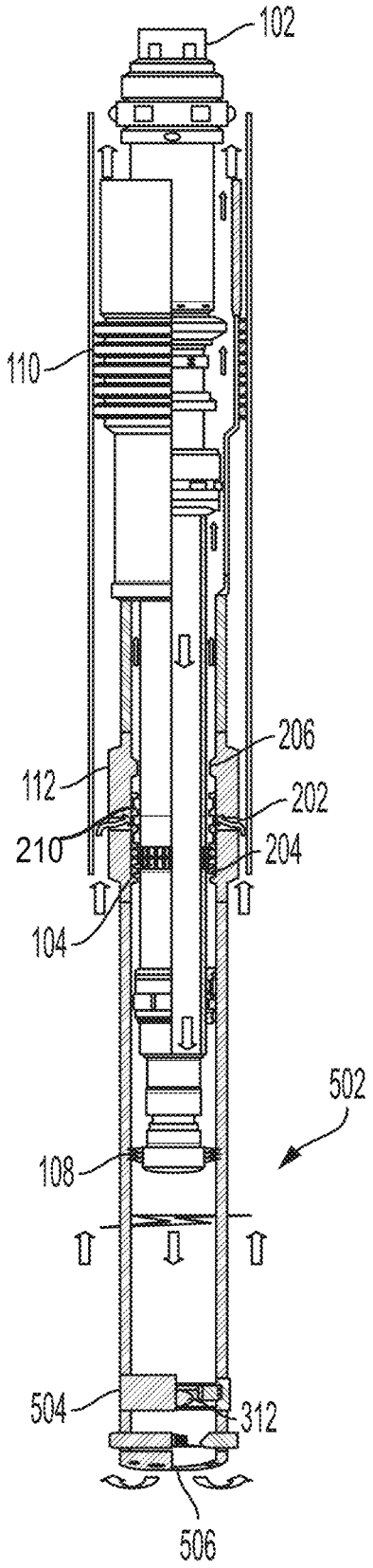
FIG. 5 is a schematic of an expandable liner hanger with a completion assembly for a cemented liner application according to one example of the present disclosure.

Another example of completion equipment with which expandable liner hangers according to various examples can be used is cemented liner equipment. For example, FIG. 5 is a schematic of an expandable liner hanger 110 with a completion assembly 502 fora cemented liner application according to one example of the present disclosure. The components of the running tool 102, expandable liner hanger 110, and circulating sleeve are the same as in FIGS. 3A-F. The completion assembly 502 for the cemented liner application can include a cementing plug 108 on a running tool 102 and a landing collar 504 located between the running tool 102 and a ported bull nose 506 of the completion assembly 502. For the cemented liner application, the running tool 102 can run, expand, and release the expandable liner hanger 110 prior to a completion operation in the same manner as depicted in FIGS. 3A-C, with the landing collar 504 of the completion assembly 502 receiving a device 312 released from the running tool 102.

The running tool 102 can be raised to couple a set-down weight feature 104 to a profile 204 of a circulating sleeve 112. Prior to the completion operation, the running tool 102 can be raised to couple the running tool 102 with an internal sleeve 210 of the circulating sleeve 112. The running tool 102 can manipulate the internal sleeve 210 to an open position to create a fluid return path through a port 202 internal to the expandable liner hanger 110. Fluid can be pumped downhole and circulate out of the ported bull nose 506 of the completion assembly 502. The fluid can flow up the wellbore 118 and through a port 202 of the circulating sleeve 112 along a return path internal to the expandable liner hanger 110. After the completion operation, the running tool 102 can detach the cementing plug 108. The cementing plug 108 can land in the landing collar 504 to prevent fluid from reaching the ported bull nose 506 and exiting the completion assembly 502. The running tool 102 can be raised to manipulate the internal sleeve 210 to close the port 202. The running tool 102 can couple the set-down weight feature 104 to a shoulder 206 of the circulating sleeve 112.

In some aspects, an assembly, an apparatus, or a method for an expandable liner hanger with a post-setting fluid flow path are provided according to one or more of the following examples:

Example 1 is an assembly comprising: an expandable liner hanger that is expandable by a running tool prior to a completion operation in a wellbore; and a circulating sleeve that is manipulatable by the running tool to provide a return path internal to the expandable liner hanger for fluid for the completion operation that is performed subsequent to releasing the running tool from the expandable liner hanger.

Example 2 is the assembly of example 1, wherein the circulating sleeve includes: a circulating housing defining at least one port for providing fluid communication between the return path and an annulus of the wellbore; a profile extending from the circulating housing to an inner area defined by the assembly for coupling to a set-down weight feature; an internal sleeve for controlling fluid communication between the inner area and the annulus through the at least one port; and a shoulder for receiving the set-down weight feature subsequent to the completion operation.

Example 3 is the assembly of examples 1-2, wherein the completion operation is a cementing operation, wherein the assembly is couplable to a cementing assembly that includes; a cementing valve shiftable to an open position for allowing cement to enter the annulus of the wellbore during the cementing operation; a packer to isolate a zone in the wellbore for the cementing operation; a ported bull nose; and a shut-off collar between the packer and the ported bull nose.

Example 4 is the assembly of examples 1-3, wherein the running tool further comprises a cementing plug that is detachable from the running tool to be received by the cementing valve.

Example 5 is the assembly of examples 1-2, wherein the completion operation is a cementing operation, wherein the running tool further comprises a cementing plug that is detachable from the running tool to be received by a landing collar of a cementing assembly, the landing collar being positionable between the running tool and a ported bull nose of the cementing assembly.

Example 6 is the assembly of examples 1-5, wherein the assembly is usable with the running tool that includes a landing element positionable downhole to the expandable liner hanger for receiving a device to allow the expandable liner hanger to expand.

Example 7 is the assembly of examples 1-6, wherein the running tool includes a packoff to seal between the running tool and an inner diameter of a liner housing for the expandable liner hanger.

Example 8 is an apparatus comprising: a running tool to run a liner hanger assembly in a wellbore; the liner hanger assembly comprising: an expandable liner hanger that is expandable by the running tool prior to a completion operation in a wellbore; and a circulating sleeve that is manipulatable by the running tool to provide a return path internal to the expandable liner hanger for fluid for the completion operation that is performed subsequent to releasing the running tool from the expandable liner hanger; and a completion assembly couplable to the liner hanger assembly.

Example 9 is the apparatus of example 8, wherein the circulating sleeve includes: a circulating housing defining at least one port for providing fluid communication between the return path and an annulus of a wellbore; a profile extending from the circulating housing to an inner area defined by the liner hanger assembly for coupling to a set-down weight feature; an internal sleeve for controlling fluid communication between the inner area and the annulus through the at least one port; and a shoulder positionable for receiving the set-down weight feature subsequent to the completion.

Example 10 is the apparatus of examples 8-9, wherein the completion operation is a cementing operation, the completion assembly comprising: a cementing valve shiftable to an open position for allowing cement to enter the annulus of the wellbore during the cementing operation; a packer to isolate a zone in the wellbore for the cementing operation; a ported bull nose; and a shut-off collar between the packer and the ported bull nose.

Example 11 is the apparatus of examples 8-10, wherein the running tool further comprises a cementing plug that is detachable from the running tool to be received by the cementing valve.

Example 12 is the apparatus of examples 8-9, wherein the running tool further comprises a cementing plug that is detachable from the running tool to be received by a landing collar of the completion assembly, the landing collar being positionable between the running tool and a ported bull nose of the completion assembly.

Example 13 is the apparatus of examples 8-12, wherein the running tool includes a landing element positionable downhole to the expandable liner hanger for receiving a device to allow the expandable liner hanger to expand.

Example 14 is the apparatus of examples 8-13, wherein the running tool includes a packoff to seal between the running tool and an inner diameter of a liner housing for the expandable liner hanger.

Example 15 is a method comprising: running, using a running tool, a liner hanger assembly in a wellbore; expanding, using the running tool, a liner hanger of the liner hanger assembly; manipulating, using the running tool, a circulating sleeve of the liner hanger assembly to provide a return path internal to the liner hanger for fluid for a completion operation; subsequent to expanding the liner hanger, releasing the running tool from the liner hanger assembly; and subsequent to releasing the running tool from the liner hanger assembly, performing the completion operation that includes using a fluid return path in an inner area defined by the liner hanger.

Example 16 is the method of example 15, wherein expanding the liner hanger of the liner hanger assembly comprises receiving a device in a landing element positioned downhole to the liner hanger of the liner hanger assembly.

Example 17 is the method of examples 15-16, wherein releasing the running tool from the liner hanger assembly comprises manipulating the landing element to cause the device to fall downhole.

Example 18 is the method of examples 15-17, wherein manipulating the circulating sleeve of the liner hanger assembly to provide a path internal to the liner hanger for fluid for a completion operation comprises at least partially raising the running tool to couple the running tool to an internal sleeve of a circulating housing.

Example 19 is the method of examples 15-18, further comprising: subsequent to the completion operation, manipulating the internal sleeve to prevent fluid from entering the return path internal to the liner hanger and receiving a set-down weight feature at a shoulder positioned uphole to the circulating housing.

Example 20 is the method of examples 15-19, wherein the completion operation is a cementing operation.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. An assembly comprising:

an expandable liner hanger that is expandable by a running tool prior to a completion operation in a wellbore; and a circulating sleeve that is manipulatable by the running tool to provide a return path internal to the expandable liner hanger for fluid for the completion operation that is performed subsequent to releasing the running tool from the expandable liner hanger, the circulating sleeve including a shoulder for receiving a set-down weight feature subsequent to the completion operation.

2. The assembly of claim 1, wherein the circulating sleeve further includes:

a circulating housing defining at least one port for providing fluid communication between the return path and an annulus of the wellbore;

a profile extending from the circulating housing to an inner area defined by the assembly for coupling to a set-down weight feature; and an internal sleeve for controlling fluid communication between the inner area and the annulus through the at least one port.

3. The assembly of claim 2, wherein the completion operation is a cementing operation, wherein the assembly is couplable to a cementing assembly that includes;

a cementing valve shiftable to an open position for allowing cement to enter the annulus of the wellbore during the cementing operation;

a packer to isolate a zone in the wellbore for the cementing operation;

a ported bull nose; and a shut-off collar between the packer and the ported bull nose.

4. The assembly of claim 3, wherein the running tool further comprises a cementing plug that is detachable from the running tool to be received by the cementing valve.

5. The assembly of claim 1, wherein the completion operation is a cementing operation, wherein the running tool further comprises a cementing plug that is detachable from the running tool to be received by a landing collar of a cementing assembly, the landing collar being positionable between the running tool and a ported bull nose of the cementing assembly.

6. The assembly of claim 1, wherein the assembly is usable with the running tool that includes a landing element positionable downhole to the expandable liner hanger for receiving a device to allow the expandable liner hanger to expand.

7. The assembly of claim 6, wherein the running tool includes a packoff to seal between the running tool and an inner diameter of a liner housing for the expandable liner hanger.

8. An apparatus comprising:

a running tool to run a liner hanger assembly in a wellbore;

the liner hanger assembly comprising:

an expandable liner hanger that is expandable by the running tool prior to a completion operation in a wellbore; and a circulating sleeve that is manipulatable by the running tool to provide a return path internal to the expandable liner hanger for fluid for the completion operation that is performed subsequent to releasing the running tool from the expandable liner hanger, the circulating sleeve including a shoulder positionable for receiving the set-down weight feature subsequent to the completion operation; and a completion assembly couplable to the liner hanger assembly.

9. The apparatus of claim 8, wherein the circulating sleeve further includes:

a circulating housing defining at least one port for providing fluid communication between the return path and an annulus of the wellbore;

a profile extending from the circulating housing to an inner area defined by the assembly for coupling to a set-down weight feature; and an internal sleeve for controlling fluid communication between the inner area and the annulus through the at least one port.

10. The apparatus of claim 8, wherein the completion operation is a cementing operation, the completion assembly comprising:

a cementing valve shiftable to an open position for allowing cement to enter the annulus of the wellbore during the cementing operation;

a packer to isolate a zone in the wellbore for the cementing operation;

a ported bull nose; and a shut-off collar between the packer and the ported bull nose.

11. The apparatus of claim 10, wherein the running tool further comprises a cementing plug that is detachable from the running tool to be received by the cementing valve.

12. The apparatus of claim 8, wherein the running tool further comprises a cementing plug that is detachable from the running tool to be received by a landing collar of the completion assembly, the landing collar being positionable between the running tool and a ported bull nose of the completion assembly.

13. The apparatus of claim 8, wherein the running tool includes a landing element positionable downhole to the expandable liner hanger for receiving a device to allow the expandable liner hanger to expand.

14. The apparatus of claim 13, wherein the running tool includes a packoff to seal between the running tool and an inner diameter of a liner housing for the expandable liner hanger.

15. A method comprising:

running, using a running tool, a liner hanger assembly in a wellbore;

expanding, using the running tool, a liner hanger of the liner hanger assembly;

manipulating, using the running tool, a circulating sleeve of the liner hanger assembly to provide a return path internal to the liner hanger for fluid for a completion operation, the circulating sleeve including a shoulder positionable for receiving the set-down weight feature subsequent to the completion operation;

subsequent to expanding the liner hanger, releasing the running tool from the liner hanger assembly; and subsequent to releasing the running tool from the liner hanger assembly, performing the completion operation that includes using a fluid return path in an inner area defined by the liner hanger.

16. The method of claim 15, wherein expanding the liner hanger of the liner hanger assembly comprises receiving a device in a landing element positioned downhole to the liner hanger of the liner hanger assembly.

17. The method of claim 16, wherein releasing the running tool from the liner hanger assembly comprises manipulating the landing element to cause the device to fall downhole.

18. The method of claim 15, wherein manipulating the circulating sleeve of the liner hanger assembly to provide a path internal to the liner hanger for fluid for the completion operation comprises at least partially raising the running tool to couple the running tool to an internal sleeve of a circulating housing.

19. The method of claim 18, further comprising:

subsequent to the completion operation, manipulating the internal sleeve to prevent fluid from entering the return path internal to the liner hanger and receiving the set-down weight feature at the shoulder positioned uphole to the circulating housing.

20. The method of claim 15, wherein the completion operation is a cementing operation.

* * * * *